US007698977B2

(12) United States Patent
Culling

(10) Patent No.: US 7,698,977 B2
(45) Date of Patent: Apr. 20, 2010

(54) COMBINED ARTICULATED JUMP CONVEYOR AND SLICING MACHINE

(75) Inventor: Alan Culling, Norfolk (GB)

(73) Assignee: AEW Delford Group Limited, Essex (GB)

( * ) Notice: Subject to any disclaimer, the term of this patent is extended or adjusted under 35 U.S.C. 154(b) by 833 days.

(21) Appl. No.: 10/993,600

(22) Filed: Nov. 19, 2004

(65) Prior Publication Data

US 2006/0107808 A1 May 25, 2006

(51) Int. Cl.
*B26D 7/32* (2006.01)

(52) U.S. Cl. ..... 83/88; 83/86; 83/90; 83/155; 83/932

(58) Field of Classification Search ..... 83/84, 83/86, 88, 90, 155, 155.1, 932, 23, 26, 27, 83/29, 91, 92, 92.1, 93–96, 167
See application file for complete search history.

(56) References Cited

U.S. PATENT DOCUMENTS

| | | | | | |
|---|---|---|---|---|---|
| 2,812,792 | A * | 11/1957 | Allbright | 83/77 |
| 2,969,099 | A * | 1/1961 | Gillman | 177/120 |
| 3,200,864 | A * | 8/1965 | Gillman | 83/73 |
| 3,821,913 | A * | 7/1974 | Bajcar et al. | 83/92 |
| 3,855,889 | A * | 12/1974 | Wiley et al. | 83/490 |
| 3,906,823 | A * | 9/1975 | Spooner | 83/73 |
| 3,933,066 | A * | 1/1976 | Spooner | 83/92 |
| 4,583,435 | A * | 4/1986 | Fessler | 83/90 |
| 4,585,227 | A * | 4/1986 | Muller | 271/270 |
| 4,684,008 | A * | 8/1987 | Hayashi et al. | 198/436 |
| 4,894,976 | A * | 1/1990 | Wallace et al. | 53/435 |
| 5,125,303 | A | 6/1992 | Hoyland | |
| 5,628,237 | A * | 5/1997 | Lindee et al. | 83/403.1 |
| 5,704,265 | A * | 1/1998 | Johnson et al. | 83/77 |
| 6,318,224 | B1 * | 11/2001 | Hoyland | 83/23 |
| 6,640,681 | B1 * | 11/2003 | Weber | 83/27 |
| 6,763,750 | B2 * | 7/2004 | Lindee | 83/88 |

FOREIGN PATENT DOCUMENTS

| | | |
|---|---|---|
| DE | 36 12 996 | * 10/1987 |
| DE | 199 36 213 | * 2/2001 |
| EP | 0 233 008 | * 8/1987 |

* cited by examiner

*Primary Examiner*—Clark F. Dexter
(74) *Attorney, Agent, or Firm*—Sughrue Mion, PLLC

(57) ABSTRACT

An apparatus for providing groups of shingled slices comprises a jump conveyor and a slicing machine. The slicing machine includes a slicing blade. The jump conveyor includes a first slice receiving section and a second slice receiving section, the first slice receiving section having a first slice receiving surface, and the second slice receiving section having a second slice receiving surface. The jump conveyor is located adjacent the slicing blade so that the first slice receiving surface receives slices cut by the slicing blade directly. The first slice receiving section is articulated with respect to the second slice receiving section to be articulatingly movable relative to the second slice receiving section to vary the angular orientation of the first slice receiving surface.

12 Claims, 5 Drawing Sheets

COMBINED ARTICULATED JUMP CONVEYOR AND SLICING MACHINE

BACKGROUND OF THE INVENTION

In slicing foodstuffs a slicing machine having a slicing blade is used to cut slices from a log of cheese, meat, or meat product at a constant repetition rate. The cut slices fall onto what is known as a jump conveyor which, typically, moves forwards at a slow speed to provide a shingle of slices and then, after a predetermined number of slices or a predetermined weight of foodstuff has been cut, accelerates and travels briefly at high speed. Recent jump conveyors have been arranged to have a fast jump operation so that the jump operation is carried out entirely in an interval between the cutting of consecutive slices. Typically a jump conveyor is followed by another conveyor which forms part of a downstream packing line. The following conveyor generally runs at a higher speed than the jump conveyor so that the separation between the groups of slices is increased as they are transferred onto the following conveyor.

A slicing machine capable of high speed operation can cut as many slices as around 1750 per minute. It is usually the jump conveyor which provides the limitation on the slicing speed because as the slicing speed of the slicer increases so the time interval between consecutive slices gets shorter and this means that the jump conveyor has less time to separate one group from another.

Our U.S. Pat. No. 5,125,303, the disclosure in which is hereby incorporated by reference, describes a combined jump conveyor and slicing machine capable of high speed operation. The arrangement described provides a jump conveyor formed of two separate conveyors. When the slicing machine is required to form shingled groups of slices then the first conveyor moves forwards slowly such that the slices are formed into a shingled group on it. Since the first conveyor is generally shorter than a group of shingled slices, during shingling both the first and second conveyor move at the same slow forwards speed and, in this way, accommodate a long shingle of slices. Once slicing of the group has been completed both the first and second conveyors are moved at a high speed in the interval between the slicing of two consecutive slices to create a gap between successive groups. As soon as the group has left the first conveyor the first conveyor can again be slowed down ready to receive the first slice of the following group. Equally, as soon as the end of the group has passed onto the second conveyor the second conveyor can carry on at high speed or can be decelerated so that the sliced group of product is transferred to a downstream packaging line at the line speed of that product. When the jump conveyor is preparing shingled groups of slices the second conveyor slows down to the shingling speed as soon as it has transferred the preceding group so that it can again cooperate with the first conveyor to hold the next shingled group as it is cut. Both conveyors of the jump conveyor have independent drive and control means to drive the two conveyors at the same speed or at different speeds. The independent drive and control means of the first conveyor also enable it to be driven at high speed in the reverse direction away from the second conveyor to reject slices cut by the slicing blade, for example when the cut face of the log is not uniform.

There has been a problem detected with the combined jump conveyor and slicing machine of U.S. Pat. No. 5,125,303 in that where particular foodstuffs, for example American Bacon, are to be sliced by the slicing machine and jump conveyor, the first few slices of a shingled group of slices are prone to sliding as they land on the first conveyor. This is generally due to the thinness of cut and dryness also sometimes the bacon is too cold and icy due to inconsistent freezing/conditioning of the product of the foodstuff. The last slices can also fall back from the acceleration of the jump function. As a result the shingled group of slices are presented in a finished pack having an uneven overlap between adjacent slices of the shingled group.

It is therefore an object of the present invention to provide an improved combined jump conveyor and slicing machine capable of providing a shingled group of slices having a constant shingle overlap in order to improve shingle pack presentation, irrespective of the foodstuff being cut.

According to a first aspect of this invention in an apparatus comprising a jump conveyor and a slicing machine for providing groups of shingled slices, said slicing machine including a slicing blade, said jump conveyor including a first slice receiving section and a second slice receiving section, said first slice receiving section having a proximal end adjacent to the slicing machine, a distal end, and a first slice receiving surface, said second slice receiving section having a second slice receiving surface, said jump conveyor being located adjacent said slicing blade so that said first slice receiving surface receives slices cut by said slicing blade directly, the improvement wherein said first slice receiving section is articulated about its distal end with respect to said second slice receiving section to be articulatingly movable relative to said second slice receiving section to vary the angular orientation of said first slice receiving surface.

With the arrangement in accordance with this invention the first slice receiving section of the jump conveyor can be articulated with respect to the second slice receiving section to present a less acute angle for the first slice of a shingled group of slices to land on. By presenting a less acute angle to the first slice a greater contact area between the first slice and the first slice receiving surface may be created upon initial contact between the first slice and the jump conveyor, thus reducing the possibility of the first slice slipping as it makes contact, and as the jump conveyor moves forward at a shingling speed. The angular orientation of the first slice receiving surface may be moved to a lowermost position which corresponds to a position in which the first slice receiving surface receives a first slice of the group of shingled slices cut by the slicing blade. Accordingly, an optimal orientation of the first slice receiving surface is created to prevent the occurrence of slipping of the first slice on the jump conveyor. Since the slices are being cut to form a shingled group of slices, the second slice of a group of shingled slices will partially overlap the first slice and so the angular orientation of the first slice receiving surface for receiving the second slice of the shingled group may be adjusted to ensure that the slices form the correct shingle overlap and that the slices do not slip on the jump conveyor. The angular orientation of the first slice receiving surface may be varied so that as subsequent slices of the shingled group are cut and land on the first slice receiving surface, the first slice receiving surface is articulatingly moved to an uppermost position corresponding to a position in which the first slice receiving surface receives a final slice of the group of shingled slices. A rate of change of angular orientation of the first slice receiving surface may be varied according to which slice of the group of shingled slices is cut by said slicing blade.

In a first preferred embodiment, the jump conveyor comprises a first conveyor including the first slice receiving section and the second slice receiving section, and a second conveyor, the second conveyor being located downstream of the first conveyor and having a third slice receiving surface. The first conveyor and the second conveyor may each have the form of a multi-element strip conveyor, the first conveyor having a proximal end located adjacent the slicing blade and a distal end located furthest from the proximal end, the second conveyor having a proximal end located adjacent the distal end of the first conveyor, the distal end of the first conveyor having a reduced diameter adjacent the proximal end of the second conveyor to facilitate smooth transfer of slices from the first conveyor to the second conveyor.

Preferably, both the first and second conveyors are driven by servomotors which have a very high torque and are controllable to a high degree. In this way the motors, and hence the conveyors, can be both accelerated and decelerated rapidly in the interval between the cutting of two consecutive slices by the slicing machine. Preferably, the first and second conveyors in the operation of the slicing machine are all under the control of a program controller, or a program logic controller, so that the timing of the speed changes in the first and second conveyor are directly coupled to the operation and slice cutting of the slicing machine. Further preferably, the first conveyor and the second conveyor each have an independent drive means controlled independently by a control means to drive and control the conveying speed of the first conveyor and the conveying speed of the second conveyor, respectively. The driving control means may drive both the first and second conveyors at a shingling speed or at a jump speed, or may drive the first conveyor at a shingling speed whilst the second conveyor is driven at a jump speed. The independent driving control means may further enable operation of the first conveyor at a high speed in the reverse direction away from the second conveyor.

Alternatively, in a second preferred embodiment, the jump conveyor comprises a first conveyor comprising the first slice receiving section, and a second conveyor comprising the second slice receiving section. The first conveyor and the second conveyor may each have the form of a multi-element strip conveyor, the first conveyor having a proximal end located adjacent the slicing blade and a distal end located farthest from the proximal end, the second conveyor having a proximal end located adjacent the distal end of the first conveyor, the distal end of the first conveyor having a reduced diameter adjacent the proximal end of the second conveyor to facilitate smooth transfer of slices from the first conveyor to the second conveyor. As in the first preferred embodiment, the first conveyor and the second conveyor may each have an independent drive means controlled independently by a control means to drive and control the conveying speed of the first conveyor and the conveying speed of the second conveyor, respectively.

According to a second aspect of this invention there is provided a method for producing the shingled group of slices using the apparatus according to the first aspect, the method comprising the steps of articulating the first slice receiving section of said jump conveyor downwards to a lowermost position relative to the second slice receiving section, driving the jump conveyor at a shingling speed, cutting a first slice of a shingled group of slices from a log of product using the slicing blade, the first slice landing on the first slice receiving surface, progressively articulating the first slice receiving section upwardly towards an uppermost position relative to the second slice receiving section as subsequent slices of the shingled group of slices are cut from the log and land on the first slice receiving section to form the shingled group of slices having a predetermined shingle overlap, accelerating the jump conveyor to a jump speed to discharge the shingled group of slices therefrom, decelerating the jump conveyor to the shingling speed whilst articulating the first slice receiving section downwardly to the lowermost position relative to the second slice receiving section, and cutting a first slice of a second shingled group of slices from the log of the product using the slicing blade, the first slice landing on the first slice receiving surface.

BRIEF DESCRIPTION OF THE DRAWINGS

Particular examples of a combined jump conveyor and slicing machine in accordance with this invention will now be described with reference to the accompanying drawings, in which:—

DESCRIPTION OF PREFERRED EXAMPLES

Figure 1:
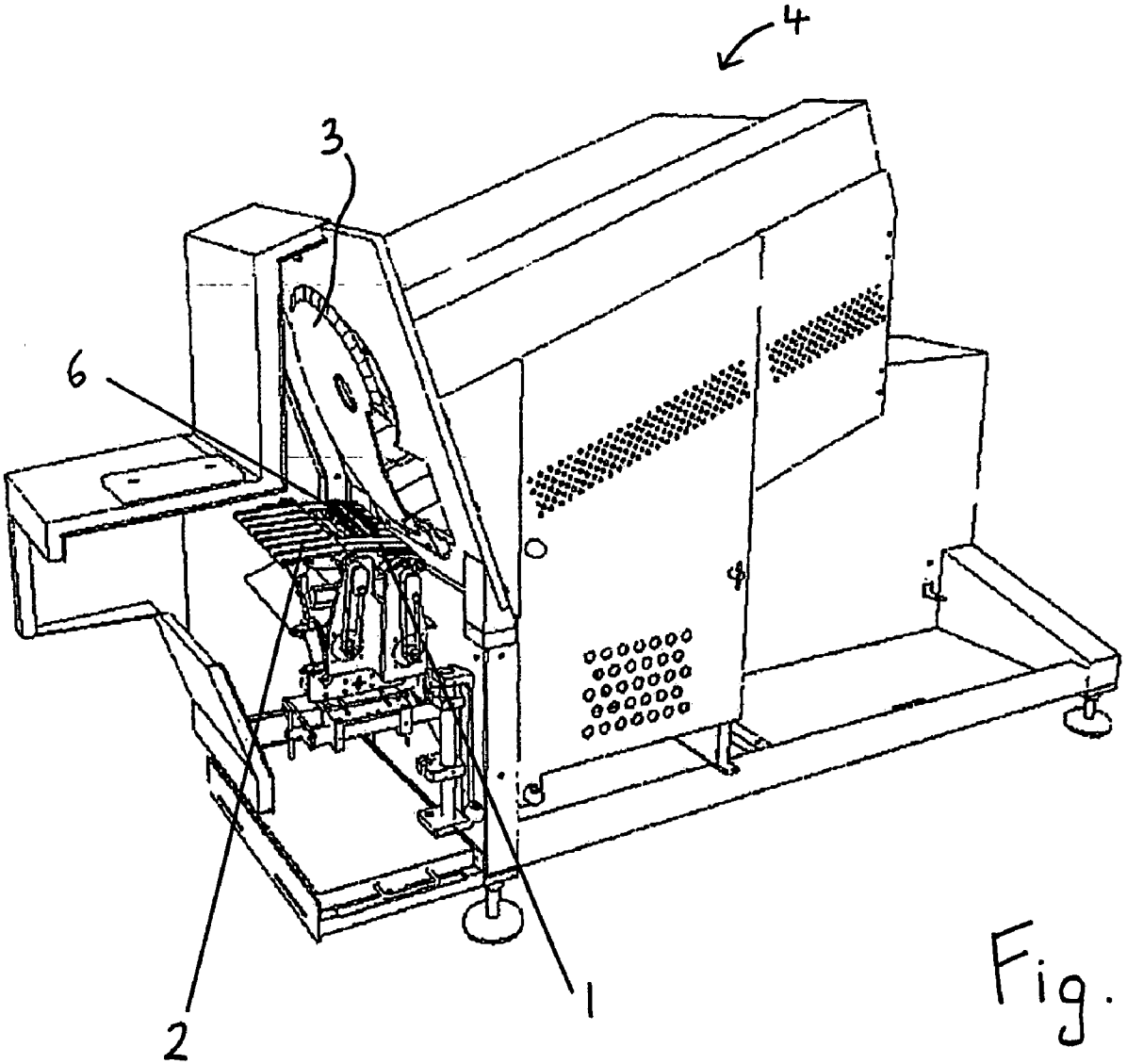
FIG. 1 is a perspective view of a combined jump conveyor and slicing machine in accordance with the first embodiment of the present invention.
Figure 2:
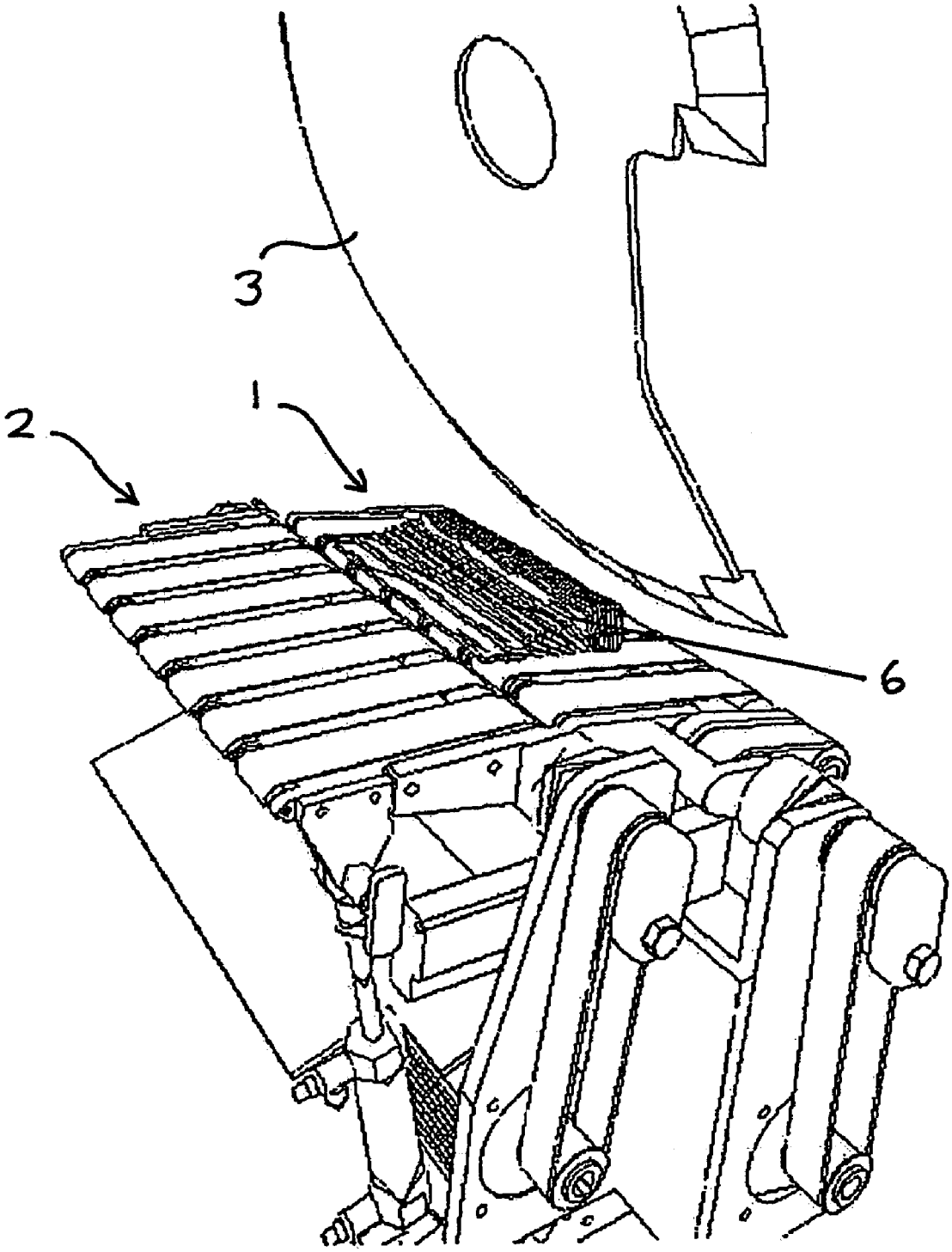
FIG. 2 is a partial view of the slicing blade and jump conveyor of FIG. 1.
Figure 3:
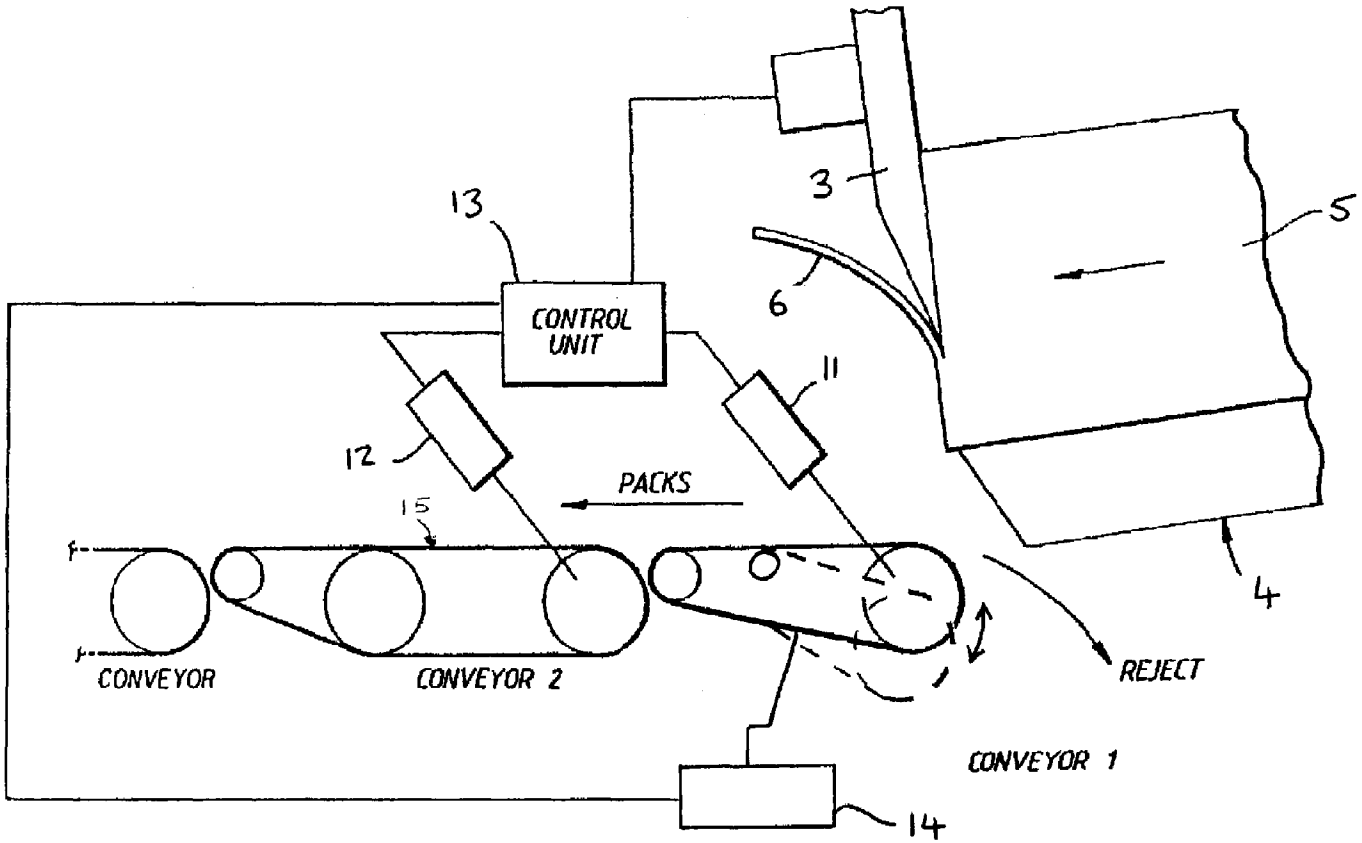
FIG. 3 is a schematic diagram of the slicing machine and jump conveyor of FIG. 1.

A combination in accordance with the first embodiment of this invention comprises a jump conveyor formed by a first conveyor 1 and a second, downstream conveyor 2, arranged to receive slices cut by a slicing blade 3 of a slicing machine indicated generally by reference numeral 4. The slicing machine is conventional in construction and is a standard "IBS 2000V" manufactured by AEW Thurne Limited of Pinetrees Road, Norwich, Norfolk, England. The slicing machine 4 cuts a log 5 of product which is moved forwards to the left as shown in FIG. 3, continuously by a drive, not shown. Slices 6 cut from the face of the log 5 fall onto the first conveyor 1. The first conveyor 1 comprises a first slice receiving section 7 and a second slice receiving section 8. The first slice receiving section 7 has an upper surface forming a first slice receiving surface 9. Said second slice receiving section 8 has an upper surface forming a second slice receiving surface 10. The second conveyor 2 has an upper surface forming a third slice receiving surface 15. Slices 6 cut from the face of the log 5 fall onto the first slice receiving surface 9. The conveyors 1 and 2 are driven by servomotors 11 and 12 and are controlled independently by a control unit 13. The first slice receiving section 7 is articulated with respect to said second slice receiving section 8. The first slice receiving section 7 is articulatingly moveable with respect to the second slice receiving section 8 by actuating pneumatic or servomotor means 14 connected to the first conveyor 1. Actuation of the servomotor or pneumatic means 14 varies the angular orientation of the first slice receiving surface 9. The angular orientation of the first slice receiving surface 9 is varied according to the foodstuff presented for slicing and according to which slice 6 of a group of shingled slices is being cut by the slicing blade 3. The pneumatic or servomotor means 14 is connected to the control unit 13 which controls the pneumatic or servomotor means 14.

Figure 4A:
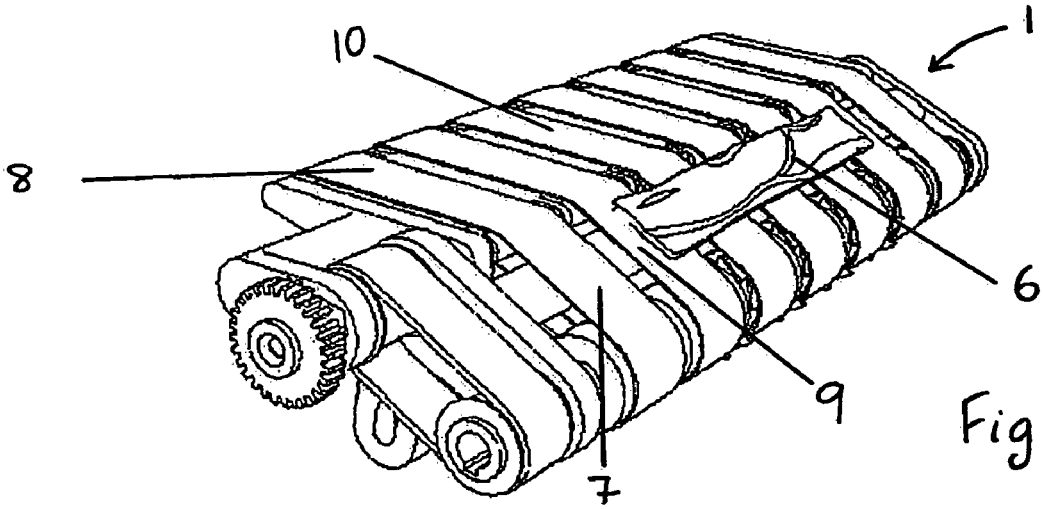
FIGS. 4A, 4B and 4C are partial perspective views of the first conveyor of the jump conveyor shown in FIG. 3 in the lowermost, intermediate and uppermost positions respectively; and, FIG. 5 is a schematic diagram of the slicing machine and jump conveyor in accordance with the second embodiment of the present invention.
Figure 4B:
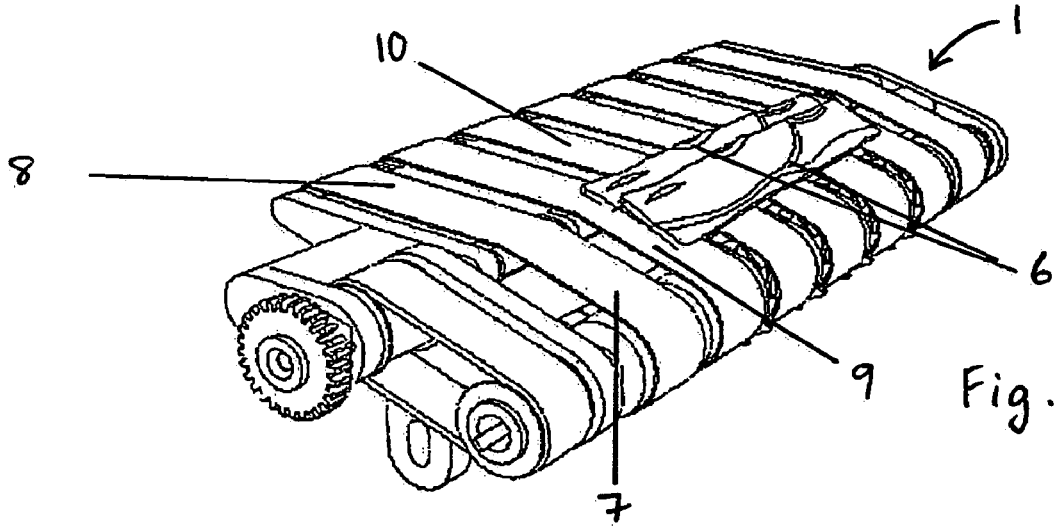
Figure 4C:
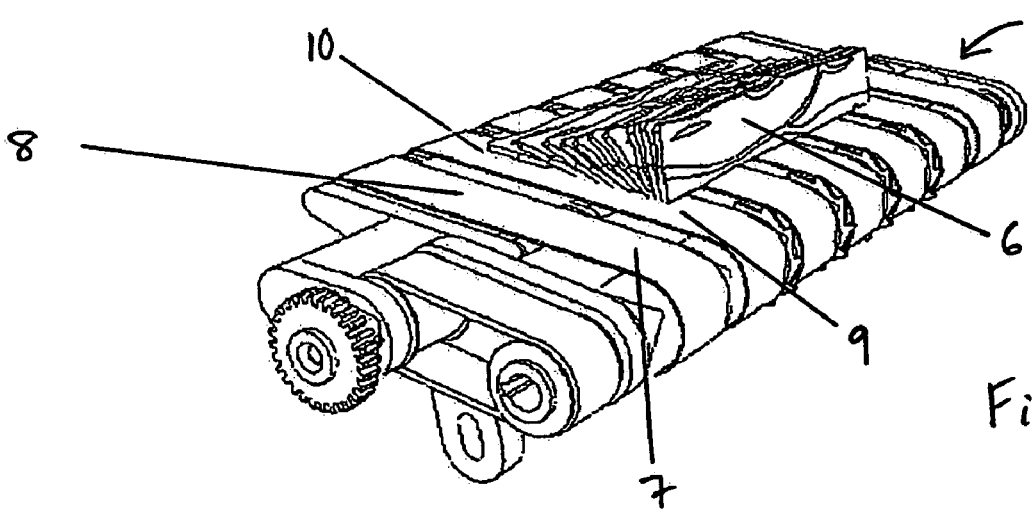

FIGS. 4A to 4C illustrate the way in which the orientation of the first slice receiving surface 9 is varied using said pneumatic or servomotor means 14 according to which slice 6 of a group of shingled slices is being cut by said slicing blade 3 from said log 5 of product. The first slice receiving section 7 is articulated downwardly to its lowermost position for receiving a first slice 6 of the group of shingled slices. The first slice receiving section 7 is then articulated partially upwardly with respect to the lowermost position for receiving a second slice 6. As subsequent slices 6 are cut by said slicing blade 3 the first slice receiving section 7 articulates to its uppermost position as shown in FIG. 4C. In this manner the first slice receiving surface 9 is orientated to an optimum angle for receiving slices 6. The optimum orientation of the first slice receiving surface 9 is selected such that the slice 6 landing on the first slice receiving surface 9 does not slip or fall backwardly as the first conveyor moves forward as shown in FIG. 3 at a shingling speed to convey the slices 6 to the second conveyor 2. The orientation of the first slice receiving surface 9 is selected such that the uppermost position is such that the final slice of a shingled group of slices does not fall backwardly as the first conveyor 1 is accelerated to a jump speed.

The way in which the speed of the two conveyors 1 and 2 are controlled in forming a shingled group of slices will now be described. Firstly, the first slice receiving section 7 of the first conveyor 1 is articulated downwardly to a lowermost position relative to the second slice receiving section 8.

The first conveyor 1 and the second conveyor 2 are both driven at a shingling speed. A first slice 6 of a shingled group of slices is cut from a log 5 of product using the slicing blade 3, the first slice 6 landing on the first slice receiving surface 9 of the first conveyor 1. If this first slice is of an inappropriate size to form a first slice of the shingled group of slices then the first conveyor 1 is driven at high speed in reverse to reject this slice 6 as shown in FIG. 3. Once a first slice 6 is cut which is of a suitable size for forming the first slice of the shingled group of slices then the first conveyor 1 and the second conveyor 2 continue to move forwardly at a shingling conveying speed. The first slice receiving section 7 is progressively articulated upwardly towards an uppermost position relative to the second slice receiving section 8 as subsequent slices 6 of the shingled group are cut from the log 5 and land on the first slice receiving surface 9 to form the shingled group of slices having a predetermined shingle overlap. Once a predetermined number of slices for forming the shingled group has been cut the first and second conveyors 1 and 2 are accelerated to a jump speed to discharge the shingled group of slices from the first conveyor 1. As soon as the final slice of the shingled group of slices has left the first conveyor 1 the first conveyor 1 is decelerated to the shingling speed whilst the first slice receiving section 7 of the first conveyor 1 is articulated downwardly to the lowermost position relative to the second slice receiving section 8. Meanwhile, the second conveyor 2 continues to be driven at the jump speed or at a line speed to discharge the shingled group of slices to a following conveyor and subsequent packing line. The above jump and articulation operation occurs in the interval between the final slice of the first shingled group being cut and the first slice of a second shingled group of slices being cut by said slicing blade 3. The timing is such that the first slice 6 of the second shingled groups falls on the first slice receiving surface 9 of the first conveyor 1 when the first conveyor 1 is operating at a shingling speed and the first slice receiving section 7 is in its lowermost position. As soon as the first group of shingled slices has been transferred from the second conveyor 2 to the following conveyor the second conveyor 2 decelerates to the shingling speed ready to cooperate with the first conveyor 1 such that the second shingled group may be formed on the upper surface of the first and second conveyors 1, 2. This process is repeated as required.

Figure 5:
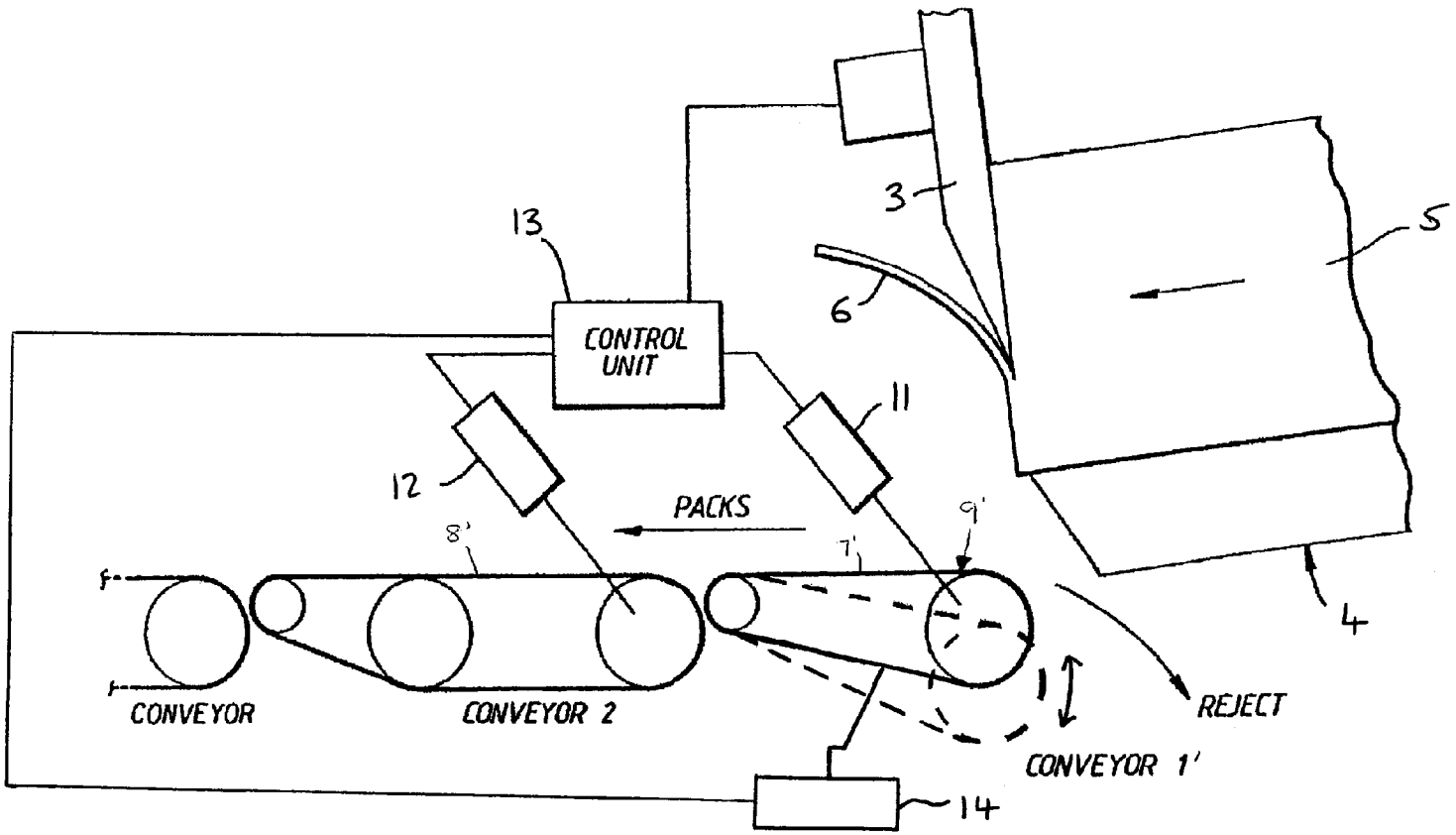

With reference to FIG. 5 there is shown a schematic diagram of the slicing machine and jump conveyor in accordance with the second embodiment of the present invention. It is to be appreciated that the only difference between the second embodiment and the first embodiment previously described is that in the second embodiment the first conveyor 11 comprises the first slice receiving section 7' and the second conveyor 2 comprises the second slice receiving section 8'. In this manner the first conveyor 1' is bodily articulatingly moveable relative to the second conveyor 2. The remaining features of the apparatus and the operation thereof is otherwise identical to that described with reference to the first embodiment and like numerals are used in FIG. 5 to denote like features of the first embodiment.

In the second embodiment of the present invention the first conveyor 1' is bodily articulatingly moveable relative to the second conveyor 2. As shown in FIG. 5 this may be achieved by articulating the proximal end of the first conveyor 1' between a lowermost and an uppermost position whilst the distal end of the first conveyor 1' remains fixed with respect to the slicing machine.

However, it is to be understood that an alternative embodiment not shown of the present invention may also be achieved by simultaneously moving the distal end of the first conveyor 1' and the proximal end of the second conveyor 2 between an uppermost and a lowermost position. The proximal end of the first conveyor 1' and the distal end of the second conveyor 2 remain fixed with respect to the slicing machine. The servomotor or pneumatic means 14 is connected to both the first and second conveyors 1',2, the actuation of which articulatingly moves the first slice receiving section 7' of the first conveyor 1' with respect to the second slice receiving section 8' of the second conveyor 2. The angular orientation of the first slice receiving surface 9' may thus be varied as required to achieve the object of the present invention. The first and second conveyors 1',2 have means to retain tension in the elements of the strip conveyors to accommodate the overall change in length of the first and second conveyors 1', 2 as they are articulated by the pneumatic or servomotor means 14. Such tension means may be rollers, for example.

I claim:

1. An apparatus comprising a jump conveyor and a slicing machine for providing groups of shingled slices, said slicing machine comprising a slicing blade, said jump conveyor comprising an endless loop, the endless loop comprising a first slice receiving section and a second slice receiving section, said first slice receiving section having a proximal end adjacent to the slicing machine, a distal end, and a first slice receiving surface, said second slice receiving section extending from said distal end and having a second slice receiving surface, said jump conveyor being located adjacent to said slicing blade so that said first slice receiving surface directly receives slices cut by said slicing blade;

wherein said first slice receiving section is articulated with respect to said second slice receiving section to be articulatingly movable, about said distal end, relative to said second slice receiving section to vary the angular orientation of said first slice receiving surface with respect to said second slice receiving surface.

2. The apparatus of claim 1, wherein a pneumatic means is provided connected to said first slice receiving section, whereby said pneumatic means is adapted to articulatingly move said first slice receiving section relative to said second slice receiving section upon actuation of said pneumatic means.

3. The apparatus of claim 1, wherein a servomotor means is provided connected to said first slice receiving section, whereby said servomotor means is adapted to articulatingly move said first slice receiving section relative to said second slice receiving section upon actuation of said servomotor means.

4. The apparatus of claim 1, wherein said first slice receiving section is articulated between a lowermost position and an uppermost position, said lowermost position corresponding to a position in which said first slice receiving surface receives a first slice of said group of shingled slices cut by said slicing blade, said uppermost position corresponding to a position in which said first slice receiving surface receives a final slice of said group of shingled slices, the angular orientation of said first slice receiving surface varying as said first slice receiving section is articulated between said uppermost and said lowermost positions.

5. The apparatus of claim 4, wherein a rate of change of angular orientation of said first slice receiving surface is varied according to which slice of said group of shingled slices is cut by said slicing blade.

6. The apparatus of claim 1, wherein said endless loon is a first conveyor, and wherein said jump conveyor further comprises a second conveyor, said second conveyor being located downstream of said first conveyor and having a third slice receiving surface.

7. The apparatus of claim 6, wherein said first conveyor and said second conveyor each have the form of a multi-element strip conveyor, said first conveyor having a first conveyor proximal end located adjacent to said slicing blade and a first conveyor distal end located farthest from said first conveyor proximal end, said second conveyor having a second conveyor proximal end located adjacent to said first conveyor distal end, the first conveyor distal end having a reduced diameter adjacent to the second conveyor proximal end to facilitate smooth transfer of slices from said first conveyor to said second conveyor.

8. The apparatus of claim 6, wherein said first conveyor and said second conveyor each have an independent drive means controlled independently by a control means to drive and control the conveying speed of said first conveyor and the conveying speed of said second conveyor, respectively.

9. The apparatus of claim 8, wherein said control means controls each of said independent drive means to drive both said first conveyor and said second conveyor at a shingling speed.

10. The apparatus of claim 8, wherein said control means controls each of said independent drive means to drive both said first conveyor and said second conveyor at a jump speed.

11. The apparatus of claim 8, wherein said control means controls said first conveyor independent drive means to drive said first conveyor at a shingling speed whilst said control means controls said second conveyor independent drive means to drive said second conveyor at a jump speed.

12. The apparatus of claim 8, wherein said control means controls said first conveyor independent drive means to drive said first conveyor at a high speed in the reverse direction away from said second conveyor.

* * * * *